US009004184B2

(12) United States Patent
Di Crescenzo et al.

(10) Patent No.: US 9,004,184 B2
(45) Date of Patent: Apr. 14, 2015

(54) METHOD AND WELLBORE SYSTEM

(75) Inventors: Daniele Di Crescenzo, Rijswijk (NL); Djurre Hans Zijsling, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 13/982,725

(22) PCT Filed: Jan. 30, 2012

(86) PCT No.: PCT/EP2012/051460

§ 371 (c)(1),
(2), (4) Date: Jul. 30, 2013

(87) PCT Pub. No.: WO2012/104256

PCT Pub. Date: Aug. 9, 2012

(65) Prior Publication Data

US 2013/0306329 A1 Nov. 21, 2013

(30) Foreign Application Priority Data

Feb. 2, 2011 (EP) ..... 11152988

(51) Int. Cl.

| | |
|---|---|
| ***E21B 43/10*** | (2006.01) |
| ***B21D 15/04*** | (2006.01) |
| ***E21B 33/12*** | (2006.01) |
| ***E21B 33/129*** | (2006.01) |

(52) U.S. Cl.

CPC ..... *E21B 43/103* (2013.01); *B21D 15/04* (2013.01); *E21B 33/1212* (2013.01); *E21B 33/1292* (2013.01); *E21B 43/105* (2013.01)

(58) Field of Classification Search

USPC ..... 166/206, 207, 382

See application file for complete search history.

(56) References Cited

U.S. PATENT DOCUMENTS

| | | | | |
|---|---|---|---|---|
| 3,162,245 | A | 12/1964 | Howard et al. | |
| 3,749,162 | A | 7/1973 | Anders | |
| 4,602,894 | A | 7/1986 | Lorenz et al. | |
| 6,854,522 | B2 * | 2/2005 | Brezinski et al. | 166/387 |

(Continued)

FOREIGN PATENT DOCUMENTS

| | | |
|---|---|---|
| EP | 2119867 | 11/2009 |
| GB | 2386626 | 9/2003 |
| WO | 03036025 | 5/2003 |

OTHER PUBLICATIONS

PCT International Search Report, Application No. PCT/EP2012/051460 dated Mar. 26, 2012.

(Continued)

*Primary Examiner* — Giovanna C Wright

(57) ABSTRACT

The invention provides a wellbore system comprising an expandable tubular element arranged in a wellbore formed in an earth formation whereby an annular space is present between the tubular element and a wall surrounding the tubular element. The tubular element is provided with sealing means for sealing the annular space, wherein the sealing means includes a foldable wall section of the tubular element. The foldable wall section has a reduced bending stiffness relative to a remainder wall section of the tubular element and is deformable from an unfolded mode to a folded mode by application of a compressive folding force to the tubular element. The foldable wall section when in the folded mode comprises at least one annular fold extending radially outward into said annular space. The wellbore system further comprises a folding device for applying said folding force to the tubular element.

15 Claims, 6 Drawing Sheets

(56) References Cited

U.S. PATENT DOCUMENTS

Figure 1:
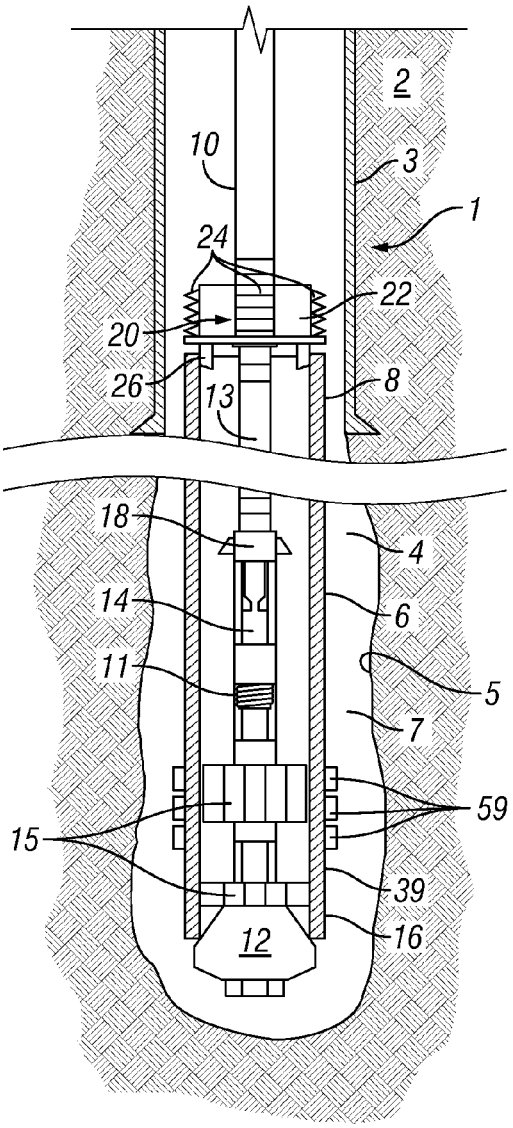

| | | | | |
|---|---|---|---|---|
| 7,077,214 | B2 * | 7/2006 | Vincent et al. | 166/387 |
| 7,104,322 | B2 | 9/2006 | Whanger et al. | |
| 7,134,506 | B2 | 11/2006 | Moyes | 166/387 |
| 2003/0205386 | A1 | 11/2003 | Johnston et al. | |
| 2004/0025772 | A1 | 2/2004 | Boatman | |
| 2004/0069374 | A1 | 4/2004 | Williamson | |
| 2004/0231860 | A1 | 11/2004 | Whanger et al. | 166/382 |
| 2006/0162921 | A1 | 7/2006 | Carmody et al. | |
| 2007/0068671 | A1 | 3/2007 | Lohbeck | |
| 2008/0185137 | A1 | 8/2008 | Palmer | 166/55.8 |
| 2008/0210432 | A1 | 9/2008 | Crossley et al. | |
| 2009/0065196 | A1 | 3/2009 | Holland et al. | 166/207 |
| 2009/0294118 | A1 | 12/2009 | Clemens | 166/89.1 |
| 2013/0312954 | A1 * | 11/2013 | Di Crescenzo et al. | 166/207 |

OTHER PUBLICATIONS

International Search Report—PCTEP2012051461 completed on Feb. 24, 2012.

* cited by examiner

METHOD AND WELLBORE SYSTEM

PRIORITY CLAIM

The present application which is a 371 application of PCT/EP2012/051460, filed Jan. 30, 2012, claims priority from European application 11152988.9, filed Feb. 2, 2011.

The present invention relates to a wellbore system whereby an expandable tubular element is arranged in a wellbore formed in an earth formation.

The wellbore is, for example, a wellbore for the production of hydrocarbon fluid. During conventional wellbore drilling, sections of the wellbore are drilled and provided with a casing or a liner in subsequent steps. In each step, a drill string is lowered through the casings already installed in the wellbore, and a new wellbore section is drilled below the installed casings or liners. In view of this procedure, each casing that is to be installed in a newly drilled wellbore section must pass through earlier installed casing. Therefore the new casing has a smaller outer diameter than the inner diameter of the earlier installed casing. As a consequence, the diameter of the wellbore available for the production of hydrocarbon fluid becomes smaller with depth. For relatively deep wells, this consequence can lead to impractically small diameters.

In conventional wellbore terminology the word "casing" refers to a tubular member extending from surface into the wellbore, and the word "liner" refers to a tubular member extending from a downhole location into the wellbore. However in the context of this description, references to "casing" and "liner" are made without such implied difference.

It has been proposed to overcome the problem of stepwise smaller inner diameters of wellbore casing by using a system whereby an expandable tubular element is lowered into the wellbore and thereafter radially expanded to a larger diameter using an expander which is pulled, pushed or pumped through the tubular element.

An example of such system is disclosed in US 2004/0231860 A1. This document discloses a wellbore in which an expandable tubular element is arranged. An end portion of the tubular element is first expanded into gripping contact with the wellbore wall using an inflatable packer, where after an expander tool is pushed through the tubular to expand the remainder thereof. The tubular element is at the outer surface provided with annular seals that are expanded against the wellbore wall together with expansion of the tubular element. The expanded seals serve to isolate an area of interest in the formation.

It is a drawback of the known system that the annular seals extend radially outward from the tubular element before expansion thereof. These annular seals may obstruct the (unexpanded) tubular element during lowering thereof into the wellbore, especially if the annulus, i.e. the radial spacing between the tubular element and the wellbore casing or wellbore wall, is relatively small.

U.S. Pat. No. 7,134,506 discloses a deformable member for a well tool for use in hydrocarbon wells. The deformable member is deformable between undeformed and deformed positions, and comprises a generally hollow cylindrical body defining a wall. The wall includes three circumferential lines of weakness in the form of grooves, with two grooves being provided in an outer surface of the wall and the other groove provided in an inner surface. The member is deformed outwardly by folding about the lines of weakness and is used to obtain contact with a tube in which the member is located.

The deformable member of U.S. Pat. No. 7,134,506 is however unsuitable to reliably obtain contact with an irregular wall, such as the wall of an open hole section of a wellbore.

US-2009/0294118 discloses a hanger assembly including a deformable section that extends radially outward upon the application of axial compression. Thus the deformed deformable member can obtain contact with a surrounding casing. On the other hand, the hanger assembly of US-2009/0294118 is unsuitable to obtain reliable contact with an irregular wall, such as the wall of an open hole section of a wellbore.

It is an object of the invention to provide an improved method and wellbore system which overcomes the drawback of the prior art.

In accordance with the invention there is provided a method comprising the steps of:

arranging an expandable tubular element in a wellbore, wherein the tubular element is provided with sealing means for sealing an annular space between the tubular element and a wall surrounding the tubular element, said sealing means including a foldable wall section of the tubular element, the foldable wall section having a reduced bending stiffness relative to a remainder wall section of the tubular element and being deformable from an unfolded mode to a folded mode by application of a compressive folding force to the tubular element, wherein the foldable wall section when in the folded mode comprises at least one annular fold extending radially outward into said annular space;

applying said folding force to the tubular element to deform the foldable wall section to the folded mode; and radially expanding the tubular element including the foldable wall section in the folded mode.

By virtue of the foldable wall section, the tubular element can be lowered into the wellbore with the foldable wall section in the unfolded mode. Thereafter the foldable wall section can be deformed to the folded mode. Thus there is no longer a need for a seal element that extends radially outward during the lowering process. The wall surrounding the tubular element can be, for example, the wellbore wall formed by the rock formation, or the wall of a casing or liner arranged in the wellbore.

The folded wall section can be expanded after folding, against said wall for zonal isolation. By expanding the folded section, the folds can be radially expanded against an irregular wall, for instance the wellbore wall in an open hole section of said wellbore, which may include wash outs or other irregularities. Thus, the method of the present invention is able to reliably and cost-effectively setting a seal for zonal isolation against an irregular surrounding wall.

Suitably the foldable wall section has a reduced wall thickness relative to said remainder wall section. By reducing the wall thickness, the bending stiffness is reduced. In this manner the foldable wall section can be made as an integral part of the tubular element.

In order to initiate folding of the section of reduced wall thickness at a predetermined location and/or to reduce the magnitude of the folding force during an initial stage of the folding process, it is preferred that the section of reduced wall thickness is provided with a relatively small annular groove extending in circumferential direction along at least one of the inner surface and the outer surface of the section of reduced wall thickness.

Preferably the foldable wall section when in the folded mode comprises a plurality of folds in a concertina shape. It is thereby achieved that each fold contributes to the sealing functionality of the sealing member.

In a preferred embodiment the foldable wall section comprises a first, a second and a third annular groove formed in the tubular element, and wherein the foldable wall section when in the folded mode includes a fold having an upper leg extending between the first and the second annular grooves, and a lower leg extending between the second and the third annular grooves. In this manner the upper leg and the lower leg bend towards each other upon applying the folding force to the tubular element. For example, suitably the first annular groove and the third annular groove are formed at one of the inner and outer surfaces of the tubular element, and the second annular groove is formed at the other of the inner and outer surfaces of the tubular element.

Each fold is formed efficiently if the folding device is an expander for radially expanding the tubular element by moving the expander through the tubular element in a direction from a first end part of the tubular element to a second end part of the tubular element, said direction defining an expansion direction. By using the expander to form the fold(s), no separate folding device needs to be applied in the wellbore. Suitably each fold is compressed against the surrounding wall as a result of radial expansion of the tubular element by the expander. Due to frictional forces between the fold(s) and the surrounding wall, the fold advantageously provides resistance against axial displacement of the tubular element in the wellbore.

Since an expansion force needs to be applied to the expander in order to move the expander through the tubular element during the expansion process, it is preferred that the reduced bending stiffness of the foldable wall section is selected such that the magnitude of the folding force is lower than the magnitude of the expansion force. It is thereby achieved that, by gradually increasing the force applied to the expander in the expansion direction, the foldable wall section is deformed into the folded mode before the expander starts expanding the tubular element.

In an advantageous embodiment, the system further comprises an anchor arranged to anchor said second end part to the tubular wall in a manner that the anchor substantially prevents movement of said second end part in the expansion direction and allows movement of said second end part in the direction opposite to the expansion direction. The anchor provides a reaction force to the tubular element counter to the expansion force, while the anchor at the same time compensates for axial shortening of the tubular element due to its radial expansion. Furthermore, the expansion force is relatively low since the tubular element is expanded under axial compression by virtue of the expander being moved towards the anchor.

In a suitable embodiment the anchor is provided with an anchor body and at least one anchor member arranged to grip said tubular wall upon a selected movement of the anchor body in the expansion direction, and wherein the anchor member is arranged to release said tubular wall upon movement of the anchor body in said direction opposite to the expansion direction.

The anchor is suitably referred to as "top anchor". To ensure that the first end part of the tubular element remains at a selected depth during the expansion process, and thereby provides a reference point for a next tubular element to be installed in the wellbore, it is preferred that the first end part is provided with a bottom anchor adapted to anchor the first end part to the wall of the wellbore as a result of radial expansion of said first end part by the expander. With the first end part anchored to the wellbore wall by the bottom anchor, axial shortening of the tubular element due to the expansion process is accommodated by the top anchor which allows movement of the second end part of the tubular element in the direction opposite to the expansion direction.

In a suitable embodiment, the bottom anchor comprises a support member having a support end fixed relative to the outer surface of the tubular element, and an anchor device having a first anchor end fixed relative to the outer surface of the tubular element and a second anchor end extending toward the support member, said second anchor end being movable relative to the outer surface of the tubular element, said anchor device including at least one hinge between said first anchor end and said second anchor end, wherein the bending moment required to bend said anchor device at the hinge is less than the bending moment required to bend another portion of said anchor device, said support member including a ramp surface that tapers in the direction of said anchor device, said first anchor end and said support end defining an initial axial device length $L_1$ there between, wherein $L_1$ is selected such that expansion of the portion of the tubular element between said support end and the first anchor end causes the axial device length to shorten to $L_2$, wherein the difference between $L_1$ and $L_2$ is sufficient to cause said second anchor end to move radially outward and engage the wellbore wall as a result of engagement with said ramp surface.

In order to prevent backflow of fluidic cement from the annular space into the liner during expansion of the liner, it is preferred that the foldable wall section is included in the first end part of the tubular element. Suitably said first end part is a lower end part of the tubular element, and said second end part is an upper end part of the tubular element.

According to another aspect, the present invention provides a wellbore system comprising:

an expandable tubular element for arrangement in a wellbore, wherein the tubular element is provided with sealing means for sealing an annular space between the tubular element and a wall surrounding the tubular element, said sealing means including a foldable wall section of the tubular element, the foldable wall section having a reduced bending stiffness relative to a remainder wall section of the tubular element and being deformable from an unfolded mode to a folded mode by application of a compressive folding force to the tubular element, wherein the foldable wall section when in the folded mode comprises at least one annular fold extending radially outward into said annular space;

the wellbore system further comprising a folding device for applying said folding force to the tubular element; and an expansion device for expanding the tubular element and for expanding the foldable wall section in the folded mode.

Figure 2:
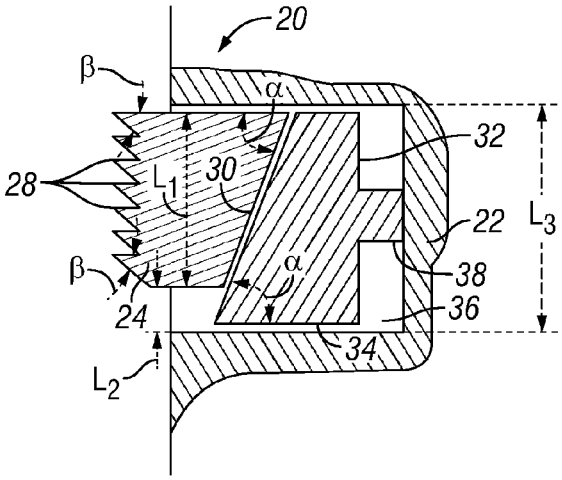
Figure 3:
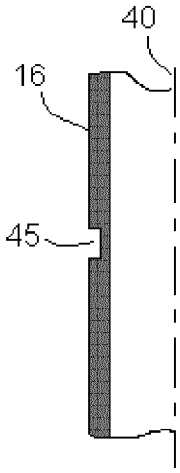
Figure 4:
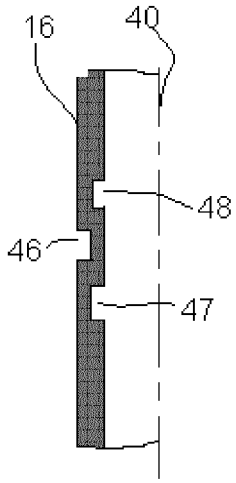
Figure 5:
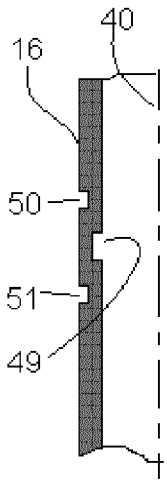
Figure 6:
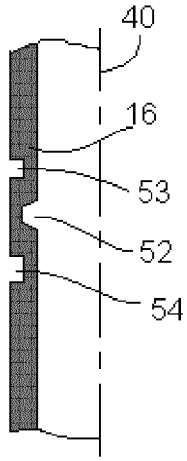
Figure 7:
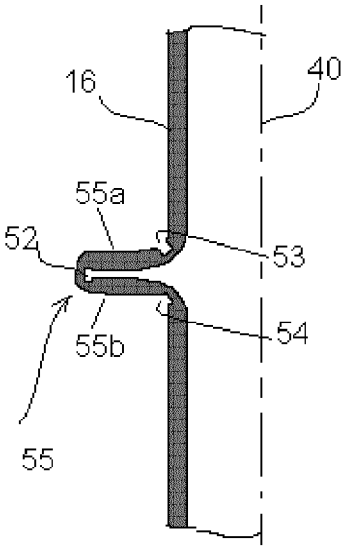
Figure 8:
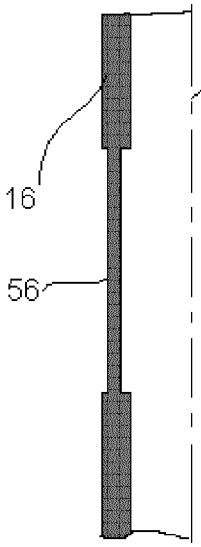
Figure 9:
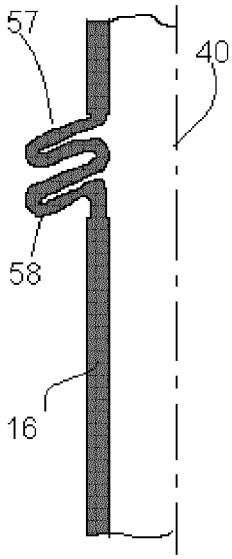
Figure 10:
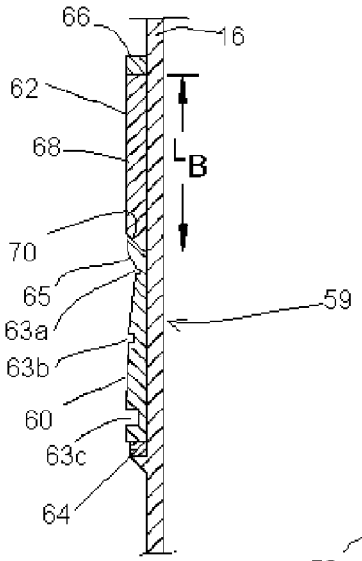
Figure 11:
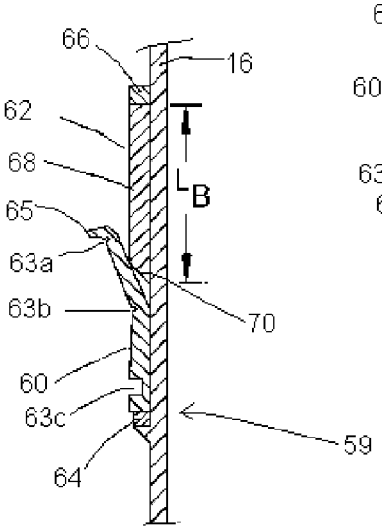
Figure 12:
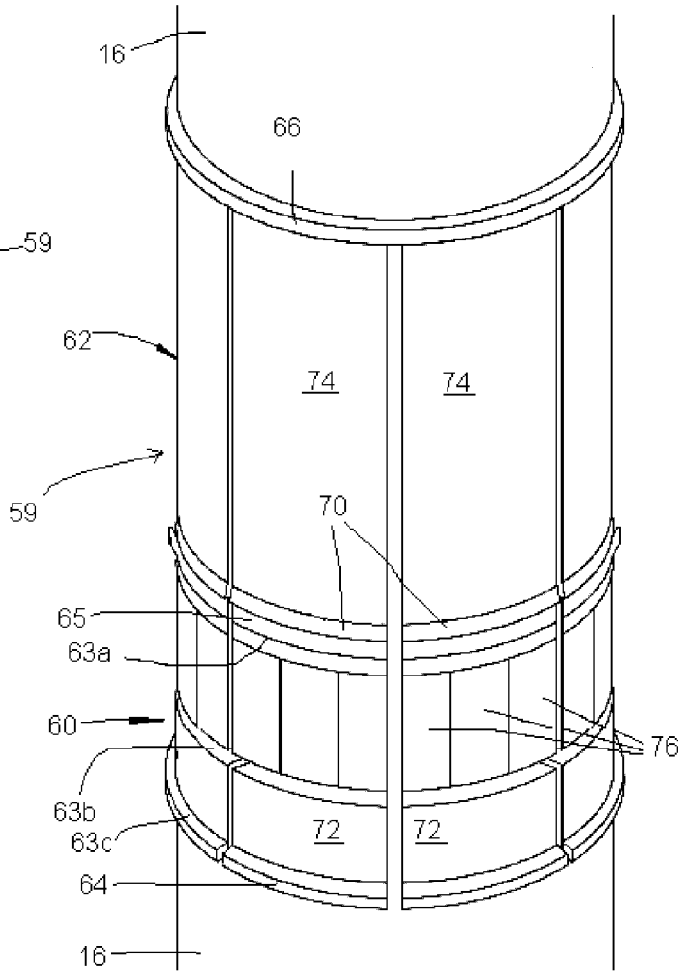
Figure 13:
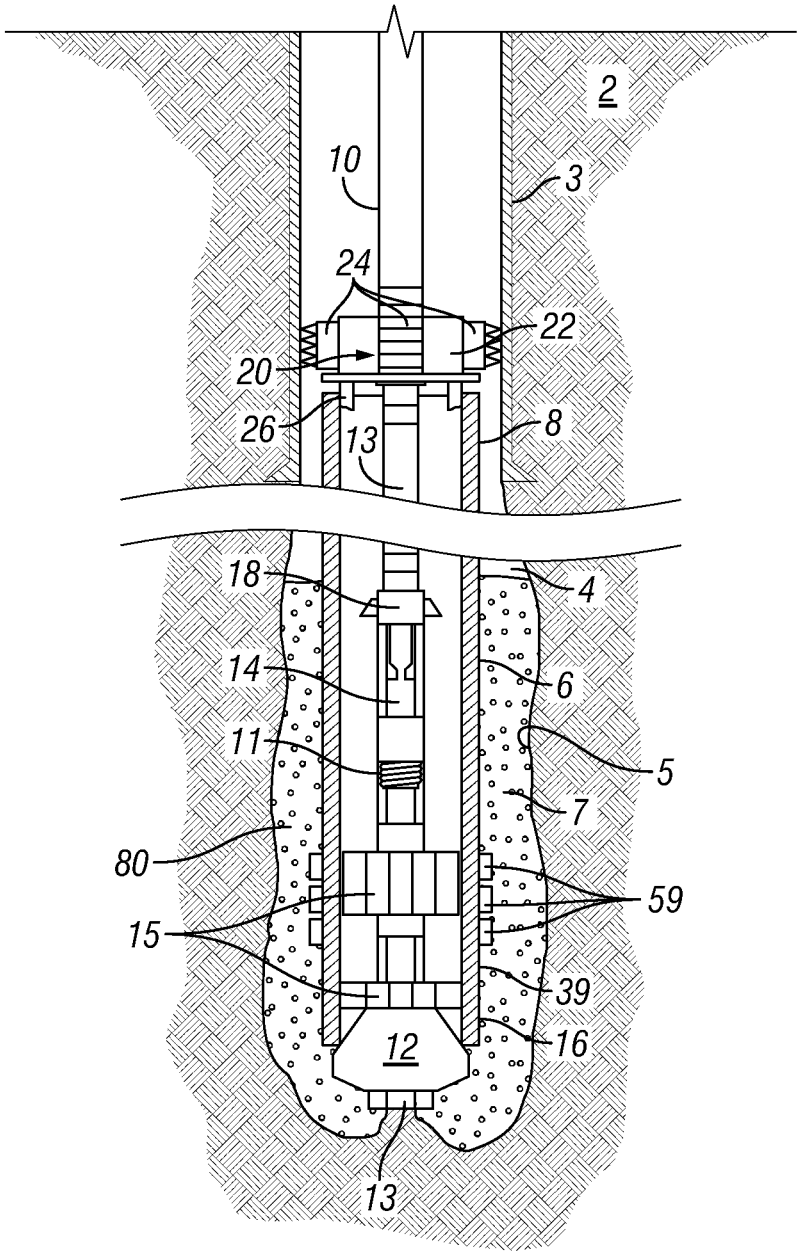
Figure 14:
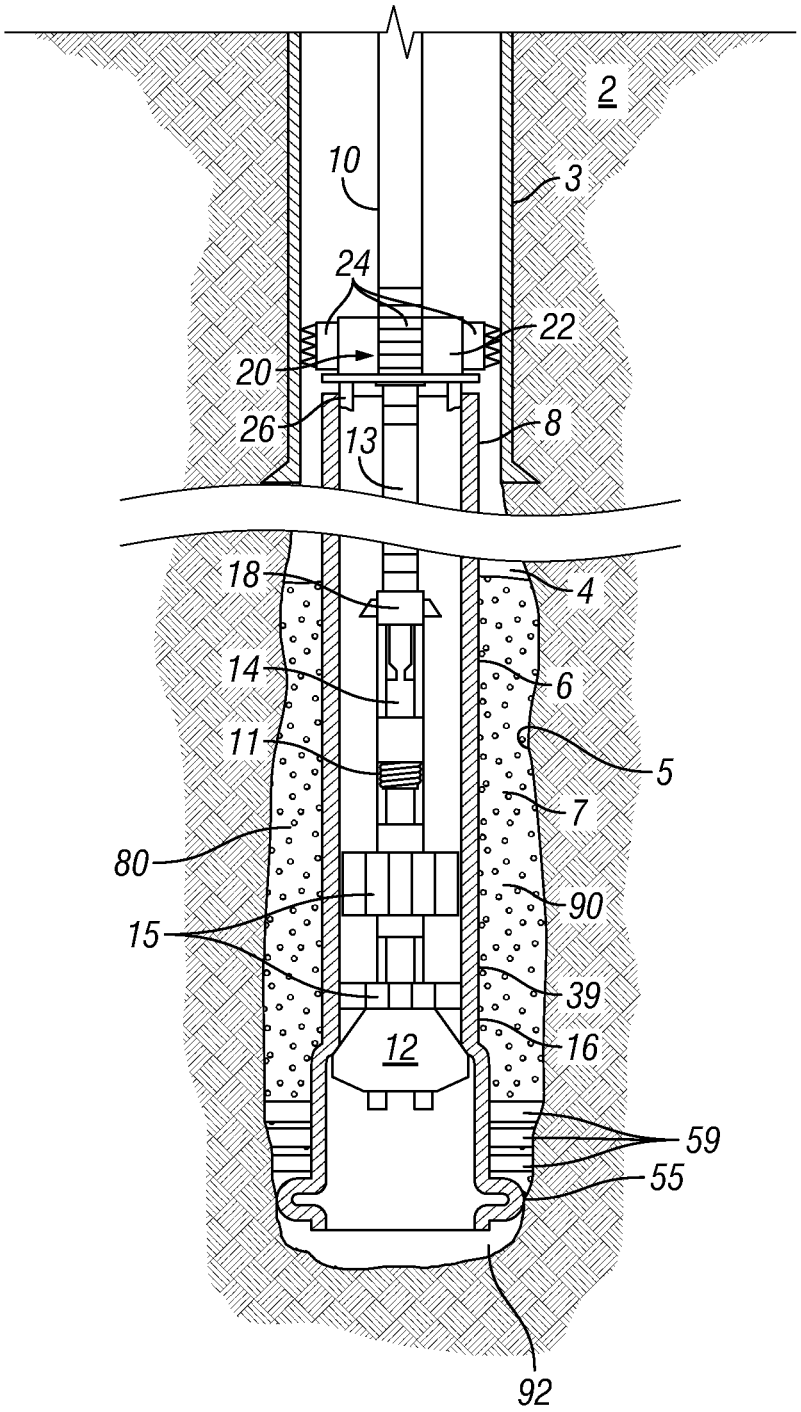
Figure 15:
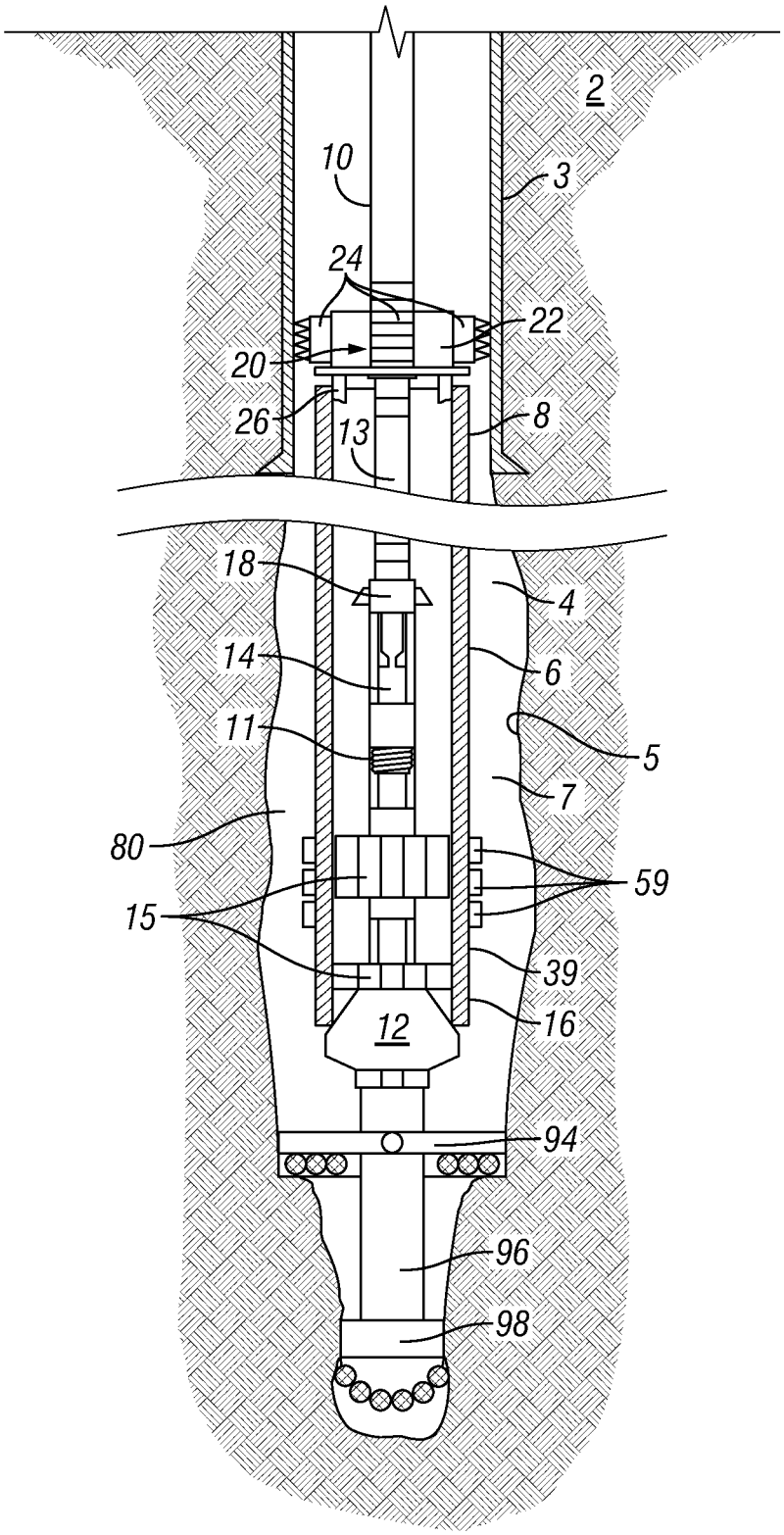

The invention will be described hereinafter in more detail and by way of example with reference to the accompanying drawings in which:

FIG. 1 schematically shows, in longitudinal section, an embodiment of the system for lining a wellbore according to the invention, whereby an expandable tubular element extends in the wellbore;

FIG. 2 schematically shows a detail of a top anchor of the embodiment of FIG. 1;

FIG. 3 schematically shows a first embodiment of a lower wall portion of the tubular element;

FIG. 4 schematically shows a second embodiment of a lower wall portion of the tubular element;

FIG. 5 schematically shows a third embodiment of a lower wall portion of the tubular element;

FIG. 6 schematically shows a fourth embodiment of a lower wall portion of the tubular element;

FIG. 7 schematically shows the fourth embodiment after folding of the lower wall portion;

FIG. 8 schematically shows a fifth embodiment of a lower wall portion of the tubular element;

FIG. 9 schematically shows the fifth embodiment after folding of the lower wall portion;

FIG. 10 schematically shows a detail of a bottom anchor of the embodiment of FIG. 1;

FIG. 11 schematically shows the bottom anchor during radial expansion of the tubular element;

FIG. 12 schematically shows a perspective view of the bottom anchor;

FIG. 13 schematically shows the embodiment of FIG. 1 after cement has been pumped into the wellbore and the top anchor has been extended against a casing in the wellbore;

FIG. 14 schematically shows the embodiment of FIG. 1 during radial expansion of the tubular element; and FIG. 15 shows an alternative embodiment of the system of the invention.

In the detailed description hereinafter, like reference numerals relate to like components.

Referring to FIG. 1 there is shown a wellbore 1 extending into an earth formation 2, the wellbore 1 being provided with a casing 3 which has been cemented in the wellbore 1, whereby an open section 4 of the wellbore 1 extends below the casing 3. Reference numeral 5 indicates the wall of open wellbore section 4. An expandable tubular element in the form of expandable liner 6 is suspended in the open wellbore section 4 whereby an upper end part 8 of the liner 6 extends into the casing 3. An annular space 7 is formed between the expandable liner 6 and the wellbore wall 5.

A drill string 10 extends from a drilling rig, or workover rig, at surface (not shown) into the wellbore 1 and passes through the interior space of liner 6. The drill string 10 is at its lower end provided with a conical expander 12 adapted to radially expand the liner 6 by pulling the drill string 10 with the expander 12 connected thereto in upward direction through the liner 6. The drill string 10 is further provided with an on/off sub 11 which allows the drill string 10 to be disconnected from the expander 12 if required. The diameter of the expander 12 is such that the expander 12 expands the upper end 8 of the liner 6 forcedly against the inner surface of the casing 3 so that a tight connection is achieved between the upper end 8 of the liner 6 and the casing 3. The drill string 10 and the expander 12 have a common central bore 13 which provides fluid communication between a pumping facility at surface (not shown) and the open wellbore section 4. The central bore 13 is provided with a dart catcher 14 (or ball catcher) for receiving a dart (or a ball) that may be pumped through the central bore 13 of the drill string 10.

As shown in FIG. 1, the expander 12 is positioned below the liner 6 before expansion of the liner is started. The expander 12 is at its upper end provided with a centraliser 15 for centralising the expander 12 relative to the liner 6. The centraliser 15 extends into a lower end part 16 of the liner 6 and is connected to the liner 6 by a releasable connection (not shown), for example one or more shear pins. The releasable connection becomes automatically disconnected when the drill string 10 pulls expander 12 upwards through the liner 6. Thus before expansion of the liner 6 commences, liner 6 is supported in the wellbore 1 by the drill string 10 whereby the weight of the liner 6 is transferred via the expander 12 to the drill string 10. Furthermore, the drill string 10 is provided with a release sub 18 arranged a short distance above the centraliser 15. The function of the release sub 18 will be explained hereinafter.

The upper end of the liner 6 is provided with a top anchor 20 comprising an anchor body 22 and a plurality of anchor members 24 mutually spaced along the circumference of anchor body 22. The top anchor 20 is releasably connected to the liner 6 by arms 26 extending from the anchor body 22 into the liner 6 and clamped to the inner surface of the liner 6.

FIG. 2 shows a detail of the top anchor 20, indicating one of the anchor members 24, the other anchor members being similar in design and functionality. The anchor member 24 has a serrated outer surface forming teeth 28, and a slanted inner surface 30 resting against a corresponding slanted surface 32 of a support element 34. The slanted surface 30 and the corresponding slanted surface 32 are complementary in shape. The anchor member 24 and the support element 34 are arranged in a chamber 36 of the anchor body 22, whereby both the anchor member 24 and the support element 34 are radially movable in chamber 36 between a retracted position and an extended position. The anchor member 24, when in the extended position, extends radially outward from chamber 36 and engages the inner surface of the liner 6. In the retracted position, the anchor member 24 is free from the inner surface of the liner 6. To move the anchor member 24 and the support element 34 between their respective retracted and extended positions, a hydraulic actuator 38 is provided in the chamber 36, the hydraulic actuator 38 being in fluid communication with the central bore 13 of the drill string 10 at a location above the dart catcher 14 so as to allow the hydraulic actuator 38 to be controlled by fluid pressure in the central bore of the drill string 10 when the central bore 13 is blocked by a dart (or ball) received in the catcher 14. The top anchor 20 is further provided with a release device (not shown) arranged to induce the support element 34 and the anchor member 24 to move to their respective retracted position when the release sub 18 of the drill string 10 is pulled against the release device of the top anchor 20.

Further, the anchor member 24 has some axial clearance in the chamber 36 so as to allow anchor member 24 to slide in axial direction a short distance along the slanted surface 32 of support element 34. As a result of such sliding movement along the slanted surface 32, the anchor member 24 when in the extended position firmly grips the inner surface of the casing 3 if the anchor body 22 is moved upwards a short distance, and the anchor member 24 releases the inner surface of the casing 3 if the anchor body 22 is moved downwards. In this manner it is achieved that the upper end part 8 of the liner 6 is allowed to move downwards due to axial shortening of the liner during radial expansion, while the top anchor 20 substantially prevents upward movement of upper end part 8 of the liner 6.

In a practical embodiment, a ramp angle $\alpha$ of the slanted surface 32 is in the range of about 5 to 30 degrees, for instance 8 to 20 degrees. An angle $\beta$, i.e. the top angle of teeth 28 on the anchor members 24 is in the range of about 60 to 120 degrees. Herein, a top surface of the teeth is substantially perpendicular to the axis of the drill string. A length or height L1 of the anchor member 24 is for instance in the range of about 0.5 to 3 times the diameter of the expandable casing 6. The axial clearance L2, i.e. a maximum stroke length of the anchor members, is for instance in the order of (diameter host casing 3− diameter expandable casing 6)/2/tan(alpha):

$$L2 = \sim(\text{diameter casing 3} - \text{diameter liner 6})/2/\tan(\alpha).$$

The length of height L3 of the chamber 36 is in the order of the length L1 of the anchor members 24+ the stroke L2 of the anchor members 24.

Reference is further made to FIGS. 3-9 showing, in longitudinal section, various embodiments of a foldable wall section 39 of the lower end part 16 of the liner 6. In each embodiment, reference numeral 40 indicates the central longitudinal axis of the liner 6.

In the first embodiment, shown in FIG. 3, an outer annular groove 45 is formed at the outer surface of the lower end part 16.

In the second embodiment, shown in FIG. 4, an outer annular groove 46 is formed at the outer surface and two inner annular grooves 47, 48 are formed at the inner surface of the lower end part 16. The inner grooves 47, 48 may be symmetrically arranged relative to the outer groove 46.

In the third embodiment, shown in FIG. 5, an inner annular groove 49 is formed at the inner surface and two outer annular grooves 50, 51 are formed at the outer surface of the lower end part 16, the outer grooves 50, 51 may be symmetrically arranged relative to the inner groove 49.

In the fourth embodiment, shown in FIGS. 6 and 7, the foldable wall section 39 includes an inner annular groove 52 at the inner surface and two outer annular grooves 53, 54 at the outer surface of the lower end part 16, the outer grooves 53, 54 being symmetrically arranged relative to the inner groove 52. The inner groove 52 tapers in radially outward direction. By virtue of the presence of the annular grooves 52, 53, 54, the lower end part 16 of the liner 6 is deformable from an unfolded mode (FIG. 6) to a folded mode (FIG. 7) by application of a selected compressive force to the lower end part 16. In the folded mode, an annular fold 55 is formed in the lower end part 16 of the liner. The annular fold 55 has an upper leg 55*a* extending between the outer groove 53 and the inner groove 52, and a lower leg 55*b* extending between the inner groove 52 and the outer groove 54. Hereinafter the compressive force that needs to be applied to the lower end part 16 to form the annular fold 55, is referred to as "folding force". It will be apparent that the magnitude of the folding force depends on the design characteristics of the lower end part 16, i.e. the material properties of the liner wall, the wall thickness, the depth and width of the annular grooves, and the axial spacing between the grooves. For example, the folding force decreases with decreasing bending stiffness of the wall of the liner 6 or with increasing depth of the grooves 52, 53, 54. Also, the folding force increases with increasing axial spacing between the grooves 52, 53, 54. It is preferred that these design characteristics are selected such that the folding force is of lower magnitude than the force required to pull the expander 12 through the liner 6 during radial expansion of the liner 6, for reason explained hereinafter.

The first, second and third embodiments of the foldable wall section described hereinbefore with reference to FIGS. 3-5, are deformable from an unfolded mode to a folded mode in a manner similar to deformation of the foldable wall section of the fourth embodiment.

In the fifth embodiment, shown in FIGS. 8 and 9, the foldable wall section 39 is formed by a section of reduced wall thickness 56 where the wall is recessed at both the inner surface and the outer surface. By virtue of the recessed wall section 56, the lower end part 16 of the liner 6 is deformable from an unfolded mode (FIG. 8) to a folded mode (FIG. 9) by application of a selected compressive force to the lower end part 16 of the liner 6, which compressive force is again referred to as "folding force". In the folded mode, a plurality of annular folds is formed in the lower end part 16 of the liner. The present example shows two annular folds 57, 58 in a concertina shape, however more annular folds can be formed in similar manner. The magnitude of the folding force depends on the design characteristics of the lower end part 16, i.e. the material properties of the liner wall, the wall thickness of the recessed section 56 of the liner 6, and the axial length of the recessed section 56. For example, the folding force decreases with decreasing bending stiffness of the recessed section 56 or with decreasing wall thickness of the recessed section 56. It is preferred that these design characteristics are selected such that the folding force is of lower magnitude than the force required to pull the expander 12 through the liner 6 during radial expansion of the liner 6, for reason explained hereinafter.

Referring further to FIGS. 10-12, the lower end part 16 of liner 6 is provided with bottom anchors 59, each bottom anchor 59 being adapted to engage the wellbore wall 5 as a result of radial expansion of the lower end part 16 so that the lower end part 16 becomes anchored to the wellbore wall 5. In FIG. 1, three such bottom anchors 59 are indicated. However any other suitable number of bottom anchors 59 can be applied.

Each bottom anchor 59 comprises an anchor arm 60 and a wedge member 62, both mounted on the outer surface of the lower end part 16 of liner 6 and vertically displaced from each other. The anchor arm 60 is provided with annular grooves 63*a*, 63*b*, 63*c* forming plastic hinges allowing radially outward bending of the anchor arm. Although three annular grooves are shown, any other number of grooves can be applied in accordance with circumstances. Furthermore, the anchor arm 60 has a fixed end 64 affixed to the outside of liner 6, for example by welding or other suitable means, and a free end 65 extending toward wedge member 62. The free end 65, also referred to as "tip", is not affixed to the outside of liner 6 so that all of anchor arm 60 except fixed end 64 is free to move relative to liner 6. The anchor arm 60 may be constructed such that its inner diameter is the same as or greater than the unexpanded outside diameter of liner 6.

Similarly, wedge member 62 includes a fixed end 66 affixed to liner 6, for example by welding or other suitable means. The free other end of the wedge member 62 extends toward the anchor arm 60 and defines a brace 68 having a length $L_B$. Brace 68 is not affixed to the outside of liner 6 and is free to move relative to the liner 6. At the free end, wedge member 62 includes a ramp 70 extending toward the anchor arm 60 and touching, or nearly touching, the free end 65 of the anchor arm 60. The ramp 70 may be constructed with any desired surface angle and may be integral with or a separate piece from brace 68. The thickness of each wedge member 62 and anchor arm 60 is a matter of design, but is limited by the maximum allowable diameter of the system prior to expansion.

Anchor arm 60 and wedge member 62 can each have either an annular and/or a segmented construction. In a segmented construction, anchor arm 60 and/or wedge member 62 may comprise longitudinal strips, rods, or plates. As shown in FIG. 12, the anchor arm 60 and the wedge member 62 each comprise for instance eight strips 72, 74 respectively. The strips 72, 74 extend around the outer circumference of the liner 6. Optionally, the strips of the anchor arm 60 and/or the wedge member 62 include a segmented section, comprising strips or fingers 76 of smaller width than the strips. The anchor arm and the wedge member may include any number of strips 72, 74 and/or corresponding fingers 76 suitable in relation to the size of the liner 6.

Hereinafter normal operation of the system of FIG. 1 is explained whereby it is assumed that the lower end part 16 of the liner 6 is provided with the fourth embodiment of the foldable wall section (shown in FIGS. 6 and 7). Normal operation of the system, if provided with the other embodiments of the foldable wall section, is similar to normal operation of the system provided with the fourth embodiment. Further it is assumed that the open wellbore section 4 has already been drilled using a conventional drill string (not shown) which has been removed from the wellbore 1.

During normal operation, the assembly formed by the drill string 10, the expander 12, the centraliser 15, the expandable liner 6 and the top anchor 20 is lowered on the drill string 10 into the wellbore until the major part of the liner 6 is positioned in the open wellbore section 4 whereby only the upper end part 8 of the liner extends into the casing 3 (as shown in FIG. 1). The anchor members 24 of the top anchor 20 are in the retracted position during the lowering operation.

Referring further to FIG. 13, in a next step a slurry of cement is pumped from surface via the central bore 13 of the drill string 10 and the expander 12 into the open wellbore section 4. The cement slurry flows into the annular space 7 between the liner 6 and the wellbore wall 5 so as to form a body of cement 80 which is still in fluidic state. Thereafter a dart (not shown) is pumped using a stream of fluid, for example drilling fluid, through the central bore 13. When the dart enters the dart catcher 14, any further passage of fluid through the central bore 13 is blocked. As a result a pressure pulse is generated in the stream of fluid, which induces the actuators 38 to move the respective anchor members 24 to their extended position so that the anchor members 24 become engaged with the inner surface of the liner 6. The fluid pressure in the stream of fluid is then temporarily further increased to release the dart from the dart catcher 14 and thereby to restore the hydraulic connection between the open hole section 4 and the drilling rig at surface.

Referring further to FIG. 14, in a next step an upward pulling force is applied to the drill string 10 so that the assembly formed by the drill string 10, the expander 12, the centraliser 15, the expandable liner 6 and the top anchor 20 moves upwards an incremental distance. While the anchor body 22 moves upwards, the anchor members 24 have a tendency of remaining stationary due to friction between the anchor members 24 and the inner surface of the liner 6. As a result the anchor members 24 slide downwards relative to the support elements 34 whereby the anchor members 24 are forced radially outward into a gripping engagement with the inner surface of the casing 3. In this manner the top anchor 20 is activated and prevents any further upward movement of the liner 6 in the wellbore 1.

The upward pulling force applied from surface to the drill string 10 is then further increased until the compressive force exerted by the expander 12 to the lower end part 16 of the liner 6 reaches the magnitude of the folding force. Upon reaching the folding force, the foldable wall section of the lower end part 16 moves from the unfolded mode to the folded mode whereby the annular fold 55 is formed. The fold 55 extends radially outward from the remainder of the liner 6 and into the annular space 7. The fold 55 thus formed may locally contact the wellbore wall 5, however that is a not yet a requirement.

After the fold 55 has been formed, the upward pulling force applied to the drill string 10 is further increased until the upward force exerted to the expander 12 reaches the magnitude of the expansion force which is the force required to pull the expander 12 through the liner 6 during expansion of the liner 6. The expander 12 is thereby pulled into the lower end part 16 of the liner 6 and starts expanding the liner 6. The centraliser 15 becomes automatically disconnected from the liner 6 by virtue of the upward movement of the expander 12. If, for example, shear pins are used to connect the centraliser 15 to the liner 6, such shear pins shear-off upon upward movement of the expander.

As a result of radial expansion of the lower end part 16 of the liner 6, the fold 55 is radially expanded and is thereby compressed against the wellbore wall 5. In this manner the expanded annular fold 55 forms a sealing member that seals an upper portion 90 of the annular space 7 above the fold 55 from a lower portion 92 of the annular space below the fold 55. Since the fold 55 is formed at the lower end part 16 of the liner, which is near the wellbore bottom, the lower portion 92 of the annular space is of minor volume relative to the upper portion 90. By virtue of the fold 55 forming a sealing member, no substantial flow-back of fluidic cement 80 from the upper portion 90 of the annular space 7 into the lower portion 92 occurs during further expansion of the liner 6.

The expansion process then proceeds by pulling the expander 12 further upwards through the liner 6. The liner 6 is subject to axial shortening due to the expansion process. Therefore, as the expander 12 passes through the lower end part 16 of the liner, at each bottom anchor 59 the axial distance between the fixed end 64 of the anchor arm 60 and the fixed end 66 of the wedge member 62 decreases. As a result, the free end 65 of the anchor arm slides onto the ramp 70 and toward the borehole wall 5, thereby overlapping the ramp 70 and extending radially outward from the liner 6. Preferably the length of the anchor arm 60 is selected such that the free end 65 thereof engages the borehole wall 5 by the time that the expander 12 passes the ramp 70.

The expander 12 subsequently progresses beyond the ramp 70, and the liner 6 continues to expand and shorten at the position of the expander. Due to the shortening, fixed end 64 of wedge member 62 moves toward anchor arm 60, and as a result ramp 70 is pushed against anchor arm 60. If the radial force on the free end of anchor arm 60, which is induced by shortening of the liner 6 due to expansion thereof, is greater than the local resistance or strength of the formation, the tip of the anchor arm 60 at the free end thereof will penetrate further into the formation.

However, if said radial force is smaller than or equal to the local resistance or strength of the formation, the tip 65 of the anchor arm 60 will be unable to penetrate further into the formation. In that case, anchor arm 60 will be held in place by the formation and ramp 70 will in turn be held in place by anchor arm 60. With the brace 68 of wedge member 62 unable to slide further along the outside of liner 6, no further shortening can occur. The final distance between fixed end 66 of wedge member 62 and fixed end 64 of anchor arm 60 is reached once the expansion device has moved past the fixed end 66 of the wedge member 62. If the free end of the wedge member 62, which comprises the ramp 70, is held in place by the anchor arm, the maximum load that is applied to the wall of the liner 6 is about equal to the so-called fixed-fixed load. The fixed-fixed load is the local load that is applied to the liner wall when the expander 12 moves between two points at which the liner is fixed, such that the liner cannot shorten between the two points. As the fixed-fixed load can be determined beforehand, for instance during lab tests, the anchor arm 60 of the invention can be designed such that the radial force exerted on the formation does not exceed the maximum allowable radial load applied to the wall of the liner 6. Thus, the anchor arm of the present invention ensures that the liner wall can be sufficiently strong to withstand the maximum radial force during expansion, so that the wall will remain substantially circular (in cross-section) when the anchor arm engages the formation. This embodiment allows the liner 6 to be designed so as to avoid collapse, even in the event that the formation is too hard to receive the anchor arm 60, as the maximum load on the liner wall will not exceed the fixed-fixed load, which can be calculated or at least determined empirically. In this manner it is prevented that collapse, rupture, or similar damage to the liner wall occurs during the expansion process. As indicated above, if the expandable liner 6 were damaged, the entire downhole section could be rendered useless and would then have to be removed, at considerable costs. The expandable liner arrangement of the present invention thus greatly improves reliability in this respect.

The radial load during expansion on the liner 6 and on the formation depends for instance on one or more of the surface angle of the ramp 70, the friction between the wedge member 62 and the liner 6, the friction between the wedge member 62 and the anchor arm 60, the formation hardness, the distance between the liner wall and the formation during expansion, etc. The surface angle of the ramp is preferably designed such that a maximum radial force is applied, whereas at the same time the radial load remains within the radial collapse load of the liner.

As the radial and axial loads on the wall of the tubular element are limited, the present embodiment is suitable for relatively hard formations, such as those, for example, having a strength or hardness of for instance 3000 psi (20 MPa) to 4000 psi (28 MPa) or more. In addition, the radial load on the wall can be limited by limiting the overlap between the anchor arm and the wedge member, and/or by limiting the contact area between the anchor arm and the formation. In a practical embodiment, the surface angle of the ramp 70 is in the range of 30 to 60 degrees, for instance about 45 degrees.

In this manner the lower end part 16 of the liner 6 is firmly anchored to the wellbore wall 5 after expansion of the lower end part 16. Therefore the position of the lower end part 16 in the wellbore 1 does not change anymore during further expansion of the liner, and thereby provides a reference point, for example during installation of a next tubular element in the wellbore at a later stage or during a workover operation in the wellbore. This is advantageous since it obviates the need to determine the position of the lower end part 16 of the liner 6 at such later stage.

With the lower end part 16 of the liner firmly anchored to the wellbore wall 5, the expander 12 is further pulled upwards through the liner 6 so as to radially expand the remaining part of the liner. The upper end of the liner with the top anchor 20 connected thereto moves downwards due to axial shortening of the liner during the expansion process, whereby the anchor members 24 automatically release the inner surface of the casing 3 as explained hereinbefore. As the expander 12 passes through the upper end part 8 of the liner 6, said upper end part 8 is thereby clad against the casing 3 so as to form a strong and fluid tight connection between the expanded liner 6 and the casing 3. Optionally the outer surface of the upper end part 8 of the liner can be provided with one or more elastomeric seals to enhance the fluid tightness between the expanded upper end 8 and the casing 3.

At this stage the release sub 18 of the drill string 10 is pulled against the release device of the top anchor 20 so that the anchor members 24 thereby move to their retracted positions. By pulling the drill string 10 further upwards, the expander 12 pushes the arms 26 of the top anchor 20 out of the upper end part 8 of the liner 6. The drill string 10 with the expander 12, the centraliser 15 and the top anchor 20 attached thereto, is then retrieved to surface.

The body of cement 80 in the annular space 7 is allowed to harden after the expansion process is finalised. By virtue of the fold 55 which forms an annular sealing member, no substantial volume of hardened cement is present in the lower portion 92 of the annular space 7 after the expansion process is completed. Therefore only a minor cement plug, or no cement plug at all, needs to be drilled out if the wellbore 1 is to be drilled deeper. If a next expandable liner is to be installed in the wellbore, the already expanded liner takes the role of the casing. It is then preferred that an expander of slightly smaller diameter or a collapsible expander is used to expand such next liner to allow the expander to be lowered with some clearance through the already expanded liner.

The alternative embodiment of the system according to the invention, as shown in FIG. 15 is similar to the embodiment described hereinbefore with reference to FIGS. 1-14, except that the drill string 10 extends below the expander 12 and is there provided with a drilling assembly including a collapsible underreamer 94 and a steerable drilling tool 96 having a pilot drill bit 98. The underreamer 94, when in collapsed mode, and the steerable drilling tool 96 are of smaller diameter than the inner diameter of the expanded liner 6 so as to allow the underreamer 94 and the steerable drilling tool 96 to be retrieved to surface through the expanded liner 6.

Normal operation of the alternative embodiment shown in FIG. 15 is similar to normal operation of the embodiment described hereinbefore with reference to FIGS. 1-14, except that the open wellbore section 4 is not drilled using a separate drill string before lowering the liner into the wellbore 1. Instead, the open wellbore section is drilled using the underreamer 94 and the steerable drilling tool 96. After drilling with the underreamer 94 and the steerable drilling tool 96, the liner 6 is expanded in the manner described hereinbefore. It is an advantage of the alternative embodiment that the liner 6 is drilled to target depth and subsequently expanded without requiring an extra round trip. In order to provide adequate flow area for drilling fluid during drilling of wellbore section 4, it is preferred that the expander 12 is collapsible to a relatively small diameter.

In an alternative embodiment, each anchor member is movable to the extended position by an activating parameter selected from a sequence of rotations and/or translations of the drill string, and a combination of hydraulic pressure in the drill string and a sequence of rotations and/or translations of the drill string.

In exemplary embodiments, the foldable wall section of the wall of the expandable tubular element may have a thickness of about 50% or less than the thickness remainder of the tubular element, for instance about 40% or less. The length of the foldable wall section is for instance in the range of about 50 to 500 mm, for instance in the range of about 75 to 150 mm. The expansion ratio of the tubular element, being the ratio of the pipe diameter of the expanded pipe relative to the pipe diameter of the pipe before expansion, may be in the range of 5 to 25%, for instance about 10 to 20%. The expansion ratio of the foldable wall section, being the ratio of the outer diameter of the foldable wall section after expansion relative to the outer diameter of the foldable wall section before expansion, may be in the range of 30% to 60%, for instance about 40 to 55%. After expansion, the folded section may seal against an enclosed wall (such as the wellbore wall), providing a fluid tightness of more than 50 bar, or for instance more than about 150 bar. Herein, fluid tightness provides zonal isolation between annular areas above and below the folded section respectively. The folding force required to expand and fold the foldable section is for instance in the range of about 250 to 1000 kN, for instance 400 to 700 kN. Tubular elements may be substantially made of solid steel.

A number of tests have been performed on pipe samples having a foldable wall section to test the forming of annular folds under compressive loading and subsequent radial expansion of the folds thus formed, as described hereinafter.

Test 1

The test samples have a foldable wall section in accordance with the fifth embodiment described hereinbefore (FIGS. 8 and 9). Furthermore, the test samples have the following characteristics:

manufacturer: V&M
material: S355J2H
outer diameter: 139.7 mm
wall thickness: 10 mm
yield strength: 388 MPa
tensile strength: 549 MPa
production method: seamless
heat treatment: normalized The pipe sample has a section with a reduced thickness of 3.5 mm, which section has a length of 100 mm. To ensure proper centralisation of the machining and a uniform wall thickness in the reduced section area, the wall has been recessed both at the inner surface and the outer surface. Furthermore a small annular groove is provided at the inner surface of the section of reduced wall thickness to initiate the folding action and lower the required compressive folding force. The pipe samples were internally lubricated with Malleus STCl lubricant prior to expansion. The expander used for expanding the samples is a Sverker21 material with an outer diameter of 140.2 mm. The expansion ratio, being the ratio of the increase in pipe diameter to the diameter before expansion, with the expander is 17%.

A compressive load was applied by the expander to the sample to cause the foldable wall section to fold into a concertina shape. The test showed that the required force to initiate the folding is about 450 kN. The applied load caused iterative formation of wrinkles on the sample, evolving to a folded section. The folded section has a lower axial stiffness and collapse resistance than the remainder of the sample, leading to a significant drop of the axial load during the formation of each fold. The outer diameter of the fold thus formed was 170.4 mm. This corresponds to an equivalent expansion ratio of 37%. The load applied to the expander was then increased to pull the expander through the pipe sample to radially expand the sample. The outer diameter of the fold after being expanded was 185.1 mm which corresponds to an equivalent expansion ratio of about 50%. The tests showed that the average expansion load, i.e. the force required to move the expander through the sample, is about 520 kN with a peak load of 650 kN during expansion of the fold.

Test 2

The test samples have a foldable wall section in accordance with the fifth embodiment described hereinbefore (FIGS. 8 and 9). Furthermore, the test samples have the following characteristics:

manufacturer: V&M
material: S355J2H
outer diameter: 139.7 mm
wall thickness: 10 mm
yield strength: 388 MPa
tensile strength: 549 MPa
production method: seamless
heat treatment: normalized The pipe sample has a section with a reduced thickness of 3.5 mm, which section has a length of 100 mm. To ensure proper centralisation of the machining and a uniform wall thickness in the reduced section area, the wall has been recessed both at the inner surface and the outer surface. Furthermore a small annular groove is provided at the inner surface of the section of reduced wall thickness to initiate the folding action and lower the required compressive folding force. The pipe samples were internally lubricated with Malleus STCl lubricant prior to expansion. The expander used for expanding the samples is a Sverker21 material with an outer diameter of 140.2 mm. The expansion ratio, being the ratio of the increase in pipe diameter to the diameter before expansion, with the expander is 17%. The sample has been placed and expanded inside a S355J2H steel pipe with an internal diameter of 174.7 mm and 9.5 mm wall thickness.

A compressive load was applied by the expander to the sample to cause the foldable wall section to fold into a concertina shape. The test showed that the required force to initiate the folding is about 450 kN. The applied load caused iterative formation of wrinkles on the sample, evolving to a folded section. The folded section has a lower axial stiffness and collapse resistance than the remainder of the sample, leading to a significant drop of the axial load during the formation of each fold. The load applied to the expander was then increased to pull the expander through the pipe sample to radially expand the sample. The outer diameter of the fold after being expanded was in contact with the internal diameter of the outer pipe which corresponds to an equivalent expansion ratio of about 41%. The tests showed that the average expansion load, i.e. the force required to move the expander through the sample, is about 520 kN with a peak load of 850 kN during expansion of the fold. The annular space between the inner and outer pipe has been subjected to water pressure. The pressure test revealed a pressure tightness of about 200 bar.

The present invention is not limited to the embodiments described above, wherein many modifications are conceivable within the scope of the appended claims. Features of respective embodiments may for instance be combined.

That which is claimed is:

1. A method comprising:

arranging an expandable tubular element in a wellbore, wherein the tubular element is provided with sealing means for sealing an annular space between the tubular element and a wall surrounding the tubular element, said sealing means including a foldable wall section of the tubular element, the foldable wall section having a reduced bending stiffness relative to a remainder wall section of the tubular element and being deformable from an unfolded mode to a folded mode by application of a compressive folding force to the tubular element, wherein the foldable wall section when in the folded mode comprises at least one annular fold extending radially outward into said annular space;

applying said folding force to the tubular element to deform the foldable wall section to the folded mode, wherein said folding force is applied using a folding device comprising an expander for radially expanding the tubular element by axially moving the expander through the tubular element in a direction from a first end part of the tubular element to a second end part of the tubular element, said direction defining an expansion direction;

radially expanding the tubular element including the foldable wall section in the folded mode; and anchoring said second end part to a casing positioned in the wellbore using an anchor, the anchor being adapted to substantially prevent movement of said second end part relative to the wall in the expansion direction and to allow movement of said second end part relative to the wall in the direction opposite to the expansion direction.

2. The method of claim 1, wherein the foldable wall section has a reduced wall thickness relative to said remainder wall section.

3. The method of claim 1, wherein the foldable wall section when in the folded mode comprises a plurality of folds in a concertina shape.

4. The method of claim 1, wherein the foldable wall section is provided with an annular groove.

5. The method of claim 4, wherein the foldable wall section comprises a first, a second and a third annular groove formed in the tubular element, and wherein the foldable wall section when in the folded mode includes a fold having an upper leg extending between the first and the second annular grooves, and a lower leg extending between the second and the third annular grooves.

6. The method of claim 5, wherein the first annular groove and the third annular groove are formed at one of the inner and outer surfaces of the tubular element, and wherein the second annular groove is formed at the other of the inner and outer surfaces of the tubular element.

7. The method of claim 1, further comprising radially expanding each fold of the foldable wall section in the folded mode and compressing each fold against a surrounding wall.

8. The method of claim 1, further comprising:

applying an expansion force to the expander in order to move the expander through the tubular element during radial expansion of the tubular element, and selecting said reduced bending stiffness of the foldable wall section such that the magnitude of the folding force is lower than the magnitude of the expansion force.

9. The method of claim 1, wherein the anchor is provided with an anchor body and at least one anchor member arranged to grip said wall upon a selected movement of the anchor body relative to the wall in the expansion direction, and wherein the anchor member is arranged to release said wall upon a selected movement of the anchor body relative to the wall in the direction opposite to the expansion direction.

10. The method of claim 9, wherein each anchor member is movable between an extended position in which the anchor member is radially extended against said wall and a retracted position in which the anchor member is radially retracted from said wall.

11. The method of claim 10, wherein an elongate string extends from surface to the anchor, the elongate string being arranged to cooperate with the anchor so as to move each anchor member between the extended position and the retracted position thereof.

12. The method of claim 11, wherein each anchor member is movable to the extended position by an activating parameter selected from hydraulic pressure in the elongate string, a sequence of rotations and translations of the elongate string, and a combination of hydraulic pressure in the elongate string and a sequence of rotations and translations of the elongate string.

13. The method of claim 10, wherein the elongate string is connected to the expander and is adapted to pull the expander through the tubular element.

14. The method of claim 1, wherein said first end part is provided with a bottom anchor adapted to anchor the first end part to the wall of the wellbore as a result of radial expansion of said first end part by the expander.

15. A wellbore system comprising:

an expandable tubular element for arrangement in a wellbore, wherein the tubular element is provided with sealing means for sealing an annular space between the tubular element and a wall surrounding the tubular element, said sealing means including a foldable wall section of the tubular element, the foldable wall section having a reduced bending stiffness relative to a remainder wall section of the tubular element and being deformable from an unfolded mode to a folded mode by application of a compressive folding force to the tubular element, wherein the foldable wall section when in the folded mode comprises at least one annular fold extending radially outward into said annular space;

a folding device for applying said folding force to the tubular element, wherein said folding device comprises an expander for radially expanding the tubular element by axially moving the expander through the tubular element in a direction from a first end part of the tubular element to a second end part of the tubular element, said direction defining an expansion direction; and an anchor for anchoring said second end part to a casing positioned in the wellbore, the anchor being adapted to substantially prevent movement of said second end part relative to the wall in the expansion direction and to allow movement of said second end part relative to the wall in the direction opposite to the expansion direction.

* * * * *